US011589724B2

(12) United States Patent
Reimels et al.

(10) Patent No.: US 11,589,724 B2
(45) Date of Patent: Feb. 28, 2023

(54) CLEANING PADS FOR AUTONOMOUS FLOOR CLEANING ROBOTS

(71) Applicant: iRobot Corporation, Bedford, MA (US)

(72) Inventors: John Reimels, Scituate, MA (US); Marcus R. Williams, Newton, MA (US); Adam Goss, Lincon, MA (US); Isaac Fowler, Cambridge, MA (US); Lucile Driscoll, Boston, MA (US)

(73) Assignee: iRobot Corporation, Bedford, MA (US)

( * ) Notice: Subject to any disclaimer, the term of this patent is extended or adjusted under 35 U.S.C. 154(b) by 281 days.

(21) Appl. No.: 17/060,818

(22) Filed: Oct. 1, 2020

(65) Prior Publication Data

US 2021/0015331 A1 Jan. 21, 2021

Related U.S. Application Data

(63) Continuation of application No. 16/205,611, filed on Nov. 30, 2018, now Pat. No. 10,791,902.

(51) Int. Cl.
*A47L 11/40* (2006.01)
*A47L 11/28* (2006.01)

(52) U.S. Cl.
CPC ..... *A47L 11/4011* (2013.01); *A47L 11/28* (2013.01); *A47L 11/4036* (2013.01); *A47L 11/4066* (2013.01); *A47L 11/4088* (2013.01); *A47L 2201/04* (2013.01); *A47L 2201/06* (2013.01)

(58) Field of Classification Search
CPC .. A47L 11/4011; A47L 11/28; A47L 11/4036; A47L 11/4066; A47L 11/4088; A47L 2201/04; A47L 2201/06
See application file for complete search history.

(56) References Cited

U.S. PATENT DOCUMENTS

| | | | | |
|---|---|---|---|---|
| 9,320,409 | B1 * | 4/2016 | Lu | A47L 11/4061 |
| 9,565,984 | B2 | 2/2017 | Lu et al. | |
| D782,139 | S | 3/2017 | Dooley et al. | |
| 10,595,698 | B2 | 3/2020 | Williams et al. | |
| 10,791,902 | B2 | 10/2020 | Reimels et al. | |
| 2003/0074756 | A1 * | 4/2003 | Policicchio | D06M 15/693 15/228 |
| 2015/0128364 | A1 | 5/2015 | Dooley et al. | |

(Continued)

OTHER PUBLICATIONS

"U.S. Appl. No. 16/205,611, Non Final Office Action dated May 1, 2020", 9 pgs.

(Continued)

*Primary Examiner* — Shay Karls
(74) *Attorney, Agent, or Firm* — Schwegman Lundberg & Woessner, P.A.

(57) ABSTRACT

An autonomous floor cleaning robot includes a robot body, a drive supporting the robot body to maneuver the robot across a floor surface, a pad holder attached to an underside of the robot body and configured to receive a removable cleaning pad, and a pad sensor configured to sense a pad type identifier on a central region of the cleaning pad. The pad type identifier includes a marker on the central region of the cleaning pad. The cleaning pad has a mounting card affixed thereto, and the pad type identifier includes an array of apertures that expose selected portions of the marker.

20 Claims, 3 Drawing Sheets

(56) References Cited

U.S. PATENT DOCUMENTS

| | | | |
|---|---|---|---|
| 2018/0344117 | A1 | 12/2018 | Williams et al. |
| 2020/0170473 | A1 | 6/2020 | Reimels et al. |

OTHER PUBLICATIONS

"U.S. Appl. No. 16/205,611, Response filed Jul. 30, 2020 to Non Final Office Action dated May 1, 2020", 9 pgs.
"U.S. Appl. No. 16/205,611, Notice of Allowance dated Aug. 21, 2020", 7 pgs.

* cited by examiner

CLEANING PADS FOR AUTONOMOUS FLOOR CLEANING ROBOTS

FIELD OF THE INVENTION

The present invention relates to cleaning pads, and in particular, to cleaning pads for autonomous floor cleaning robots.

BACKGROUND

An autonomous cleaning robot can navigate across a floor surface while mopping the floor surface to clean the floor surface. The cleaning robot can include a cleaning pad to mop the floor surface. As the cleaning robot moves across the floor surface, the cleaning pad wipes the floor surface and collects debris.

SUMMARY OF EMBODIMENTS OF THE INVENTION

In certain systems, an autonomous floor cleaning robot can spray water on a floor and then drive a pad across the wetted floor surface, such as to clean the floor. As the pad is driven across the wetted floor surface, surface forces, such as adhesion/stiction, etc., can provide a force between the floor the and cleaning pad. Increases in the magnitude of force between the floor and the cleaning pad, such as due to an increased size of the cleaning pad, can cause difficulties during cleaning, such as bending or deformation of the cleaning pad. The cleaning pad can include a mounting card that can provide mechanical stability to the cleaning pad. The mounting card can be formed from a material such as cardboard. A size of the mounting card can be selected, such as to provide improved mechanical stability without unnecessarily increasing cost. For example, a mounting card extending across an entire length of the cleaning pad can provide improved mechanical stability, but the increase in cost may not be acceptable. Likewise, a mounting card extending over a relatively small length of the cleaning pad may be economical to manufacture, but may not provide adequate mechanical stability.

In some embodiments, an autonomous floor cleaning robot includes a robot body, a drive supporting the robot body to maneuver the robot across a floor surface, a pad holder attached to an underside of the robot body and configured to receive a removable cleaning pad, and a pad sensor configured to sense a pad type identifier on a central region of the cleaning pad. The pad type identifier includes a marker on the central region of the cleaning pad. The cleaning pad has a mounting card affixed thereto, and the pad type identifier includes an array of apertures that expose selected portions of the marker. In particular embodiments, the cleaning pad and mounting card may be sized and configured for increased stability and cleaning surface. The inventors have recognized, among other things, that the dimensions of the mounting card relative to the pad may provide mechanical stability and/or a larger cleaning surface.

In some embodiments, the pad holder comprises protrusions engageable with cutouts on the mounting card of the cleaning pad.

In some embodiments, the pad holder protrusions are configured to engage with cutouts on a side of the mounting card such that the protrusions are configured to engage the mounting card in a single orientation. The pad holder may include side rails that further retain the mounting card together with the protrusions in a single orientation. In some embodiments, the pad holder is configured to retain the mounting card in the single orientation such that the marker is positioned adjacent the pad sensor.

In some embodiments, the floor cleaning robot further comprises a controller that identifies a type of the cleaning pad based on the pad sensor detecting the exposed portions of the marker. In some embodiments, the pad sensor is configured to sense a sequence of exposed portions of the marker to indicate a type of cleaning pad selected from a plurality of cleaning pad types stored in a memory of the controller. In some embodiments, the controller is configured to select a robot cleaning mode based on the selected sequence of exposed portions of the marker.

In some embodiments, the pad holder is configured to receive a cleaning pad having a mounting card such that a length of the mounting card is at least 8 cm, and a length of the cleaning pad is at least 20 cm. In some embodiments, a width of the mounting card is at least 7 cm and a width of the cleaning pad is of at least 8 cm.

In some embodiments, the pad holder is configured to receive a cleaning pad having a mounting card such that a ratio of a length of the mounting card to the length of the pad is at least 2.0. In particular embodiments, the ratio of a length of the mounting card to the length of the pad is at least 2.2.

In some embodiments, a cleaning pad and mounting card assembly for an autonomous floor cleaning robot includes a cleaning pad having a marker on a central region thereof; and a mounting card affixed to the cleaning pad, the mounting card comprising an array of apertures that expose selected portions of the marker.

In some embodiments, a length of the mounting card is at least 8 cm, and a length of the cleaning pad is at least 20 cm.

In some embodiments, a width of the mounting card is at least 7 cm and a width of the cleaning pad is of at least 8 cm.

In some embodiments, a ratio of a length of the mounting card to the length of the pad is at least 2.0.

In some embodiments, the ratio of a length of the mounting card to the length of the pad is at least 2.2.

In some embodiments, the mounting card comprises protrusions engageable with protrusions on a pad holder of an autonomous floor cleaning robot.

In some embodiments, the protrusions are configured to engage the mounting card in a single orientation with respect to the robot.

In some embodiments, the exposed selected portions of the marker define a cleaning pad type.

BRIEF DESCRIPTION OF THE DRAWINGS

The accompanying drawings, which are incorporated in and constitute a part of the specification, illustrate embodiments of the invention and, together with the description, serve to explain principles of the invention.

DETAILED DESCRIPTION OF EMBODIMENTS OF THE INVENTION

An autonomous floor-cleaning robot can include a pad holder configured to receive a removable cleaning pad for cleaning a floor surface, and a pad sensor. The pad sensor can be configured to sense a pad type identifier, which may be positioned on the cleaning pad. The pad type identifier can include an arrangement of a marker on the cleaning pad. In particular, the cleaning pad may include a mounting card affixed thereto. The mounting card may include an array of apertures that expose selected regions of the marker. In some embodiments, the cleaning pad and mounting card may be sized and configured for increased stability and cleaning surface. The inventors have recognized, among other things, that the dimensions of the mounting card relative to the pad may provide mechanical stability and an increased floor cleaning pad surface.

Figure 1:
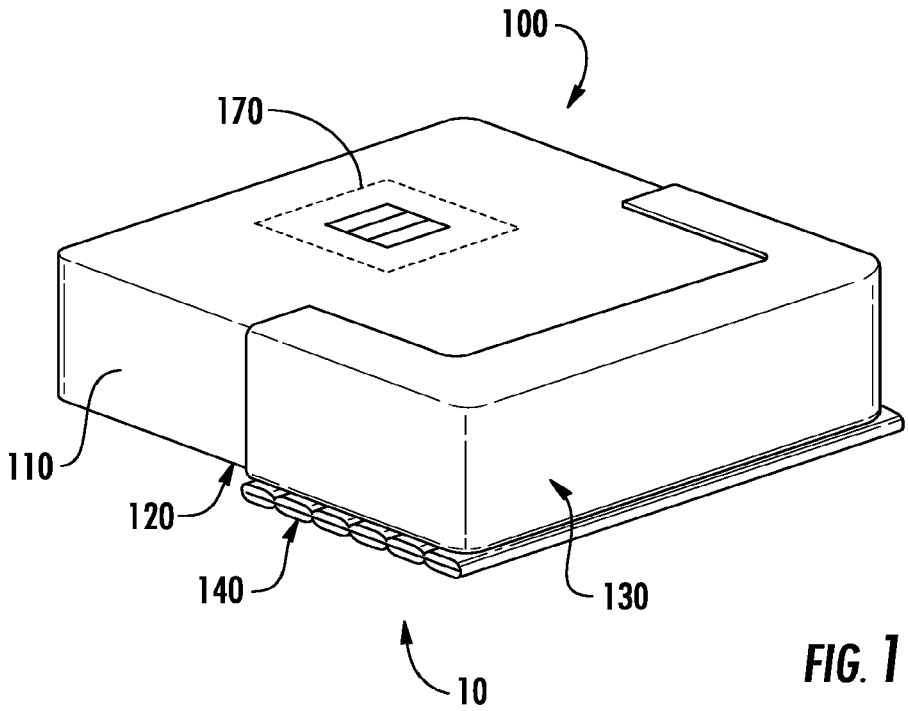
FIG. 1 is a perspective view of an autonomous floor-cleaning robot according to some embodiments.
Figure 2:
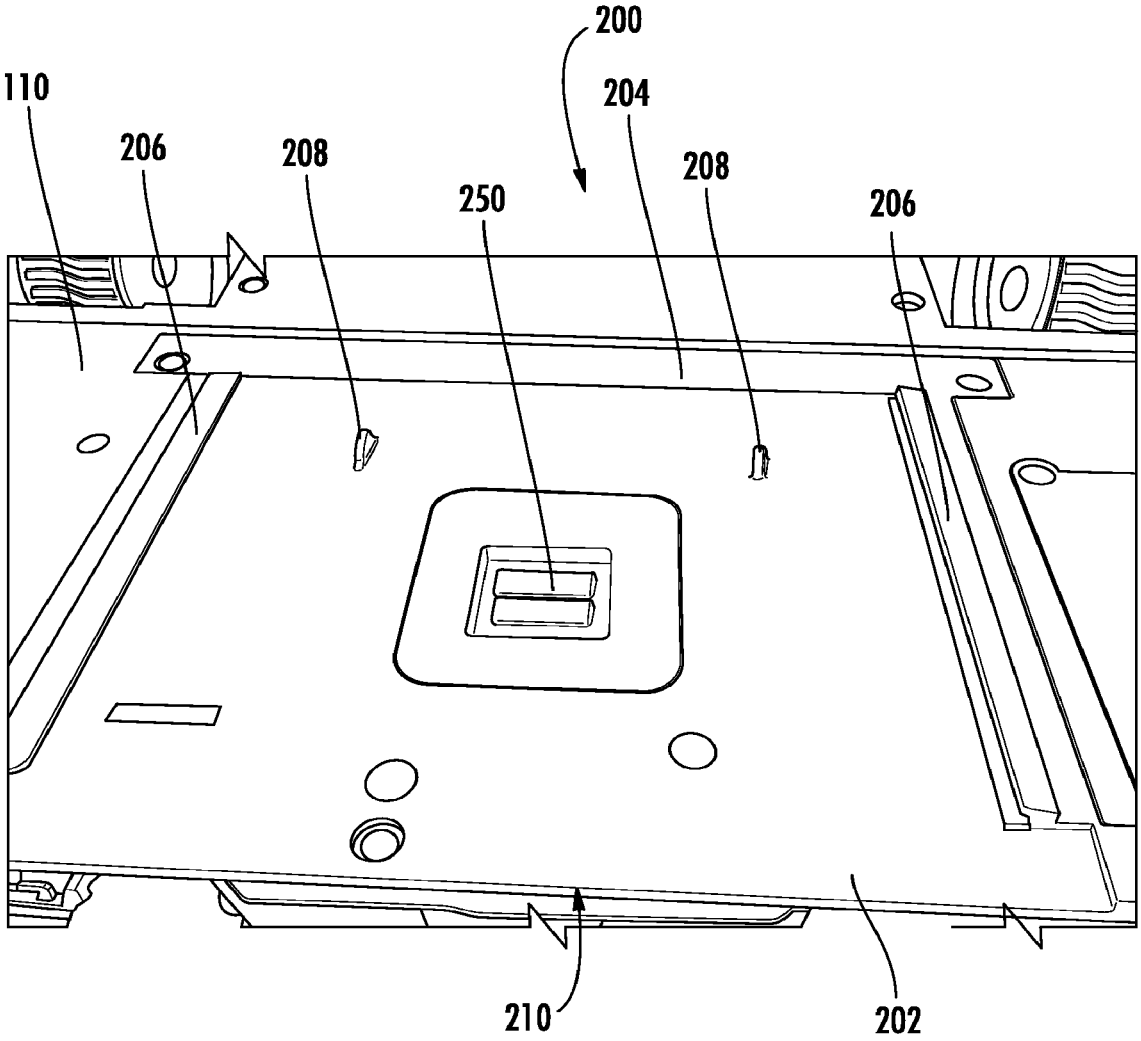
FIG. 2 is a perspective view of a pad holder on the autonomous floor-cleaning robot of FIG. 1.

As illustrated in FIG. 1, an autonomous floor cleaning robot 100 includes a robot body 110, a drive 120 supporting the robot body to maneuver the robot 100 across a floor surface, a bumper 130, a cleaning pad 140 that is attached to an underside of the robot body 110, and a processor 170. As shown in FIG. 2, a pad holder 200 is mounted on an underside of the robot body 110 and configured to receive a cleaning pad and mounting card assembly 10, including the cleaning pad 140. The robot body 110 also includes a pad sensor 250 in a central region of an underside of the body 110. The pad sensor 250 communicates sensed data to the processor 170 of the robot 100.

The pad holder 200 includes a planar base 202, a back holding rail 204, side rails 206 and two protrusions 208. The side rails 206 define a front opening 210.

Figure 3:
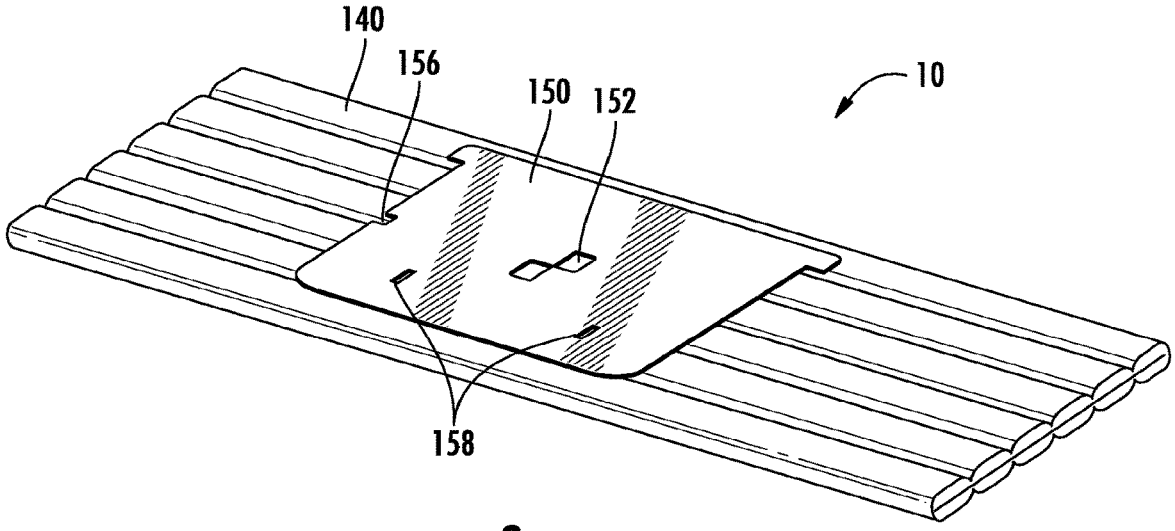
FIG. 3 is a perspective view of a pad for the autonomous floor-cleaning robot of FIG. 1.
Figure 4:
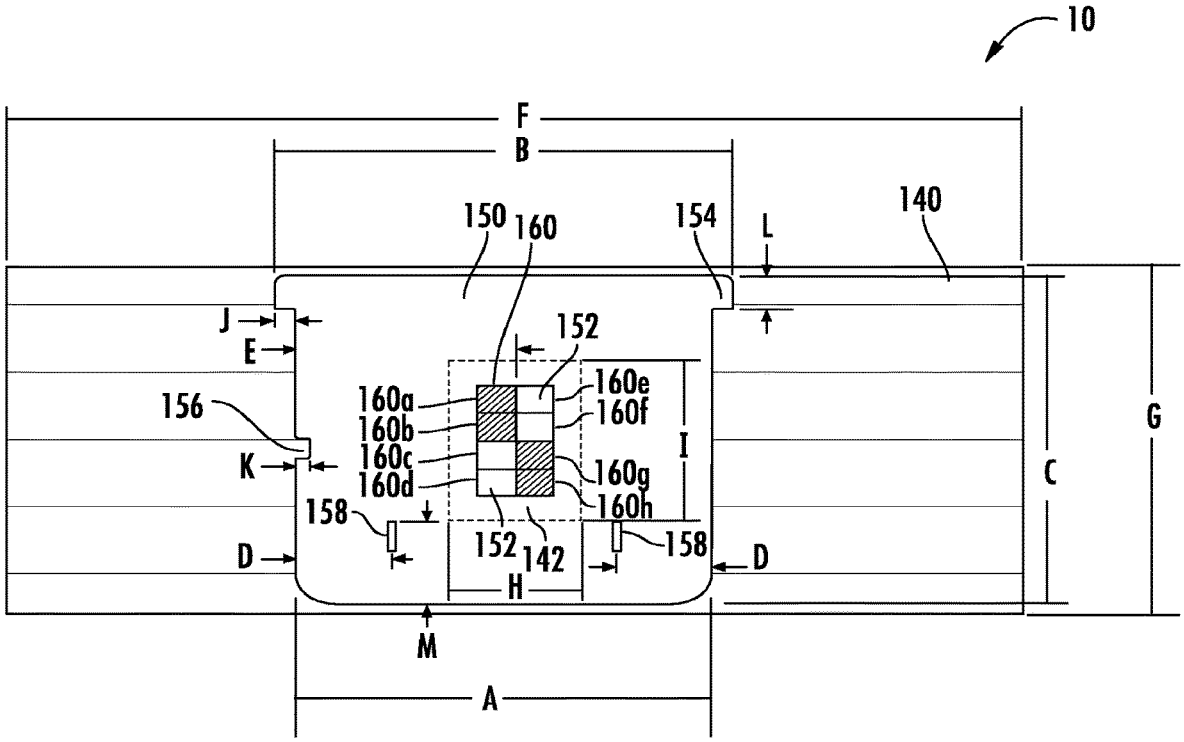
FIG. 4 is a top view of the pad of FIG. 3 with an identification sequence thereon.

As shown in FIGS. 3-4, the cleaning pad and mounting card assembly 10 includes a cleaning pad 140 and has a mounting card 150 affixed to the pad 140. The mounting card 150 includes apertures 152, tab extensions 154, a notch 156 and apertures 152. As shown in FIG. 4, the cleaning pad 140 includes a marker 142 (shown in dashed lines as underneath the card 150) in the central region of the pad 140 that is visible through the apertures 152. The marker 142 has a color that contrasts with the color of the card 150.

In this configuration, cleaning pad mounting card 150 is slideably received through the front opening 210 of the pad holder 200 (FIG. 2) and held in position such that the protrusions 208 engage and extend through the apertures 152 of the mounting card 150. The side rails 206 hold the sides of the card 150 in position such that the tab extensions 154 face the opening 210 of the holder 200. Accordingly, the pad 140 is held in position by the pad holder 150 and the mounting card 150 such that pad sensor 250 faces the apertures 152 of the card 150. Because of the position of the tab extensions 154, which abut the side rails 206, and the cooperating positions of the protrusions 208 and the apertures 152, the card 150 and pad 140 are held by the pad holder 200 in a single orientation, and apertures 152 are in a prescribed two-dimensional alignment with the center of the pad 150.

As shown in FIG. 4, the apertures 152 may be formed as part of an identification sequence 160. The identification sequence 160 is a construct of regions that is defined by the processor 170 and/or sensor 250 in a portion of the card 150 that is positioned such that it can be sensed by the sensor 250 on the robot 100. As shown, the identification sequence 160 includes identification elements 160*a*-160*h* that define regions that are either exposed by an aperture 152 or covered by the card 150. Thus, the identification elements 160*a*-160*h* are in one of two states: the color of the marker 142 (a dark state) or the color of the card 150 (light state). Although eight identification elements 160*a*-160*h* are shown, it should be understood that any number of identification elements may be used to define a suitable number of states to identify the pad.

As illustrated, identification elements 160*a*, 160*b*, 160*g*, and 160*h* include regions of the marker 142 on the pad 150, which are exposed by the apertures 152, and the identification elements 160*c*, 160*d*, 160*e*, and 160*f* show a portion of the card 150, which obscures the marker 142 on the pad 140. Thus, the identification elements 160*a*, 160*b*, 160*g*, and 160*h* are sensed by the sensor 250 as dark (or the color and/or pattern of the marker 142), and the identification elements 160*c*, 160*d*, 160*e*, and 160*f* are sensed by the sensor 250 as light (or the color of the card 150). It should be understood that the apertures 152 may be configured to expose different regions of the marker 142 such that any number of the predefined identification elements 160*a*-160*h* of the sequence 160 include exposed regions of the marker 142 or covered areas of the card 150.

The mounting card 150 may have a first length A between 8 and 16 cm, e.g., 8 cm to 12 cm, 10 cm to 14 cm, 12 cm, to 16 cm, or 9 to 16 cm or more, a second length B (taken along the tab extensions 154) that is about 1 cm longer than the first length A, and a width C that is about 7 cm to 14 cm, e.g., 7 cm to 10 cm, 9 cm to 12 cm, 10 cm to 13 cm, or 8 cm to 12 cm or more In particular embodiments, the first length A is about 11 cm, the second length B is about 12 cm, and the width C is 9.5 cm. The apertures 152 are a distance D of about 2 to 5 cm from the edge of the card 150. In some embodiments, the ratio of the distance D to the first length A (D/A) is between 0.20 and 0.40, e.g., between 0.20 and 0.35, between 0.25 and 0.35 or between 0.25 and 0.30 A distance E from the edge of the card 150 defines the midpoint of the mounting card 150 and a center of the marker 142. The distance E is about half of the length A. In some embodiments, the cleaning pad 140 may have a length F of at least 15, 20, 25 or 30 cm or more and a width G of at least 8, 9, 10, 11, 12, 13, 14 or 15 cm or more. In particular embodiments, the length F is 26.5 cm and the width G is 11 cm. In some embodiments, the ratio of the width C to the width G (C/G) is between 0.60 and 1.0, e.g., between 0.75 and 0.95, between 0.85 and 0.90 or between 0.90 and 0.95. The marker 142 on the pad 140, which extends under the card 150 has a length I of about 2, 3, 4, 5, 6, or 7 cm and a width H of about 2, 3, 4, or 5 cm. In particular embodiments, the length I is about 4.5 cm and the width His about 3.0 cm, and the ratio of the length I and the width His about 1.0, 1.5 or 2.0. The tab extensions 154 have a width J of about 0.3; 0.4, 0.5 to 0.7, 0.8, 0.9 or 1.0 cm, and a length L of about 0.5, 0.6, 0.7 to 0.9, 1.0, 1.1, or 1.2 cm. The notch 156 is extends about 0.4, 0.5, or 0.6 cm into the card 150. In some embodiments, the ratio of the area of the card 150 to the area of the pad 140 is between 0.20 and 0.80, e.g., between 0.30 and 0.70, between 0.30 and 0.60, between 0.20 and 0.40 and between 0.25 and 0.50. In some embodiments, the distance M is between 1.0 cm and 2.0 cm, or between 1.3 cm and 1.7 cm, or between 1.3 and 1.5 cm.

In particular embodiments, the ratio of the length B of the mounting card to the length F of the pad may be between 1.5 to 4.0, e.g., between 1.5 to 3.5, between 2.0 to 3.0, or between 2.5 to 2.

The marker 142 on the pad 140 may be any suitable visual identification marker, such as colored ink or dye. The identification mark may include a colored ink. In some embodiments, the marker 142 can include encoded information, such as a bar code or other pattern. The robot 100 may sense the attached cleaning pad 140 by sensing the identification marker 142 of the cleaning pad 140 with the sensor 250. The sensor 250 may be a visual sensor or camera, and the marker 142 may be sensed by detecting a spectral response of the identification marker 142. The contrasting colors of the marker 142 and the card 150 are shown as dark and light, respectively; however, any color(s) may be used and/or the marker 142 may be a light color and the card 150 may be a dark color.

As illustrated, the marker 142 includes colored ink or dye that extends in an area on the pad underneath the card 150. The apertures 152 on the card 150 expose the marker 142 underneath the card such that the sensor 150 detects one of two states: 1) the exposed ink or dye of the marker 142, and 2) the card 150. The color of the marker 142 that is visible through the apertures 152 contrasts with the color of the card 150 such that the robot sensor 250 can sense to identify the pattern of the exposed marker 142 or the card 150.

The cleaning pad 150 may be one of a set of available cleaning pad types having different pad or cleaning properties that may be detected by the sequence 160 as sensed by the sensor 250. The data from the sensor 250 regarding the pad-identifying sequence 160 may be communicated to the processor 170, and the processor 170 may identify the pad 140 based on the identification sequence 160. In some examples, a method of cleaning a floor includes attaching a cleaning pad to an underside surface of an autonomous floor cleaning robot, placing the robot on a floor to be cleaned, and initiating a floor cleaning operation. In the floor cleaning operation, the robot senses the attached cleaning pad and identifies a type of the pad from among a set of multiple pad types and then autonomously cleans the floor in a cleaning mode selected according to the identified pad type. Examples of cleaning pad types include the following:

- A wet mopping cleaning pad that can be scented and pre-soaped.
- A damp mopping cleaning pad that can be scented, pre-soaped, and requires less cleaning fluid than the wet mopping cleaning pad.
- A dry dusting cleaning pad that can be scented, infiltrated with mineral oil, and does not require any cleaning fluid.
- A washable cleaning pad that can be re-used and can clean a floor surface using water, cleaning solution, scented solution, or other cleaning fluids.

In some examples, the wet mopping cleaning pad, the damp mopping cleaning pad, and the dry dusting cleaning pad are single-use disposable cleaning pads. The wet mopping cleaning pad and the damp mopping cleaning pad can be pre-moistened or pre-wet such that a pad, upon removal from its packaging, contains water or other cleaning fluid. The dry dusting cleaning pad can be separately infiltrated with the mineral oil.

In some embodiments, the cleaning pad type defines a corresponding robot cleaning behavior, which may be executed by the processor 170 or a controller on the robot 100. The robot behavior defined by the cleaning pad type may include a navigation behavior of the robot (such as whether or how often the robot moves over a particular area of the floor), a fluid spraying schedule that determines how often the robot sprays a cleaning fluid on the floor or adds cleaning fluid to the pad, and/or a vibration schedule that determines how often the robot vibrates the cleaning pad to further loosen debris. Examples of navigation behavior, fluid spraying schedules, and/or vibration schedules are discussed in detail in U.S. Pat. No. 9,565,984, the disclosure of which is incorporated by reference in its entirety.

The present invention is described herein with reference to the accompanying drawings and examples, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under," "below," "lower," "over," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of "over" and "under." The device may be otherwise oriented (rotated 90 degrees or at other orientations) and the spatially relative descriptors used herein interpreted accordingly. Similarly, the terms "upwardly," "downwardly," "vertical," "horizontal" and the like are used herein for the purpose of explanation only unless specifically indicated otherwise.

It will be understood that, although the terms "first," "second," etc. may be used herein to describe various elements, these elements should not be limited by these terms. These terms are only used to distinguish one element from another. Thus, a "first" element discussed below could also be termed a "second" element without departing from the teachings of the present invention. The sequence of operations (or steps) is not limited to the order presented in the claims or figures unless specifically indicated otherwise.

The foregoing is illustrative of the present invention and is not to be construed as limiting thereof. Although a few example embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. A cleaning pad assembly securable to a cleaning robot, the cleaning pad assembly comprising:

a cleaning pad connectable to a pad holder mountable to an underside of a robot body of the cleaning robot, the cleaning pad including:

a pad type identifier including a marker on the cleaning pad; and a mounting card connected to the cleaning pad and securable to the pad holder to secure the cleaning pad and the mounting card to the cleaning robot, the mounting card defining a set of apertures that expose selected portions of the marker, the mounting card including tabs insertable into side rails of the pad holder to retain the mounting card.

2. The cleaning pad assembly of claim 1, wherein the pad type identifier and the marker are located on a central portion of the cleaning pad.

3. The cleaning pad assembly of claim 2, wherein a length of the mounting card is at least 8 cm and a length of the cleaning pad is at least 20 cm.

4. The cleaning pad assembly of claim 3, wherein a width of the mounting card is at least 7 cm and a width of the cleaning pad is of at least 8 cm.

5. The cleaning pad assembly of claim 1, wherein the mounting card includes cutouts configured to receive protrusions of the pad holder.

6. The cleaning pad assembly of claim 5, wherein the cutouts are located on a side of the mounting card such that the cutouts are configured to receive the protrusions to secure the mounting card to the pad holder in a single orientation.

7. The cleaning pad assembly of claim 6, wherein the tabs are configured to retain the mounting card together with the protrusions and the cutouts in a single orientation.

8. The cleaning pad assembly of claim 7, wherein the tabs, marker, and apertures are located such that the marker is positioned adjacent a pad sensor of the pad holder when the mounting card is secured to the pad holder.

9. The cleaning pad assembly of claim 1, wherein the pad type identifier is configured to indicate a type of pad of the cleaning pad to a pad sensor of the cleaning robot.

10. A cleaning pad assembly securable to a cleaning device, the cleaning pad assembly comprising:

a cleaning pad having a marker located on a central region of the cleaning pad; and a mounting card connected to the cleaning pad, the mounting card including an array of identification elements configured to expose portions of the marker and cover other portions of the marker to indicate a cleaning pad type, the mounting card including:

a pair of tabs insertable into side rails of a pad holder of the cleaning device; and a pair of mounting apertures configured to receive a pair of protrusions of the pad holder, respectively, at least partially therein.

11. The cleaning pad assembly of claim 10, wherein the identification elements include an array of apertures that expose the portions of the marker.

12. The cleaning pad assembly of claim 11, wherein the mounting card includes eight identification elements.

13. The cleaning pad assembly of claim 10, wherein the mounting card includes mounting cutouts engageable with protrusions of a pad holder of an autonomous floor cleaning robot.

14. The cleaning pad assembly of claim 13, wherein the mounting card cutouts are configured to receive the protrusions in a single orientation of the mounting card with respect to the pad holder.

15. A cleaning pad assembly securable to a cleaning robot, the cleaning pad assembly comprising:

a cleaning pad connectable to a pad holder mountable to an underside of a robot body of the cleaning robot, the cleaning pad including:

a pad type identifier including a marker on the cleaning pad; and a mounting card connected to the cleaning pad and securable to the pad holder to secure the cleaning pad and the mounting card to the cleaning robot, the mounting card defining an array of apertures that expose selected portions of the marker, the mounting card including a pair of tabs insertable into side rails of the pad holder to retain the mounting card.

16. The cleaning pad assembly of claim 15, wherein the pad holder is configured to receive a cleaning pad having a mounting card such that a ratio of a length of the mounting card to the length of the pad is at least 2.0.

17. The cleaning pad assembly of claim 16, wherein the ratio of a length of the mounting card to the length of the pad is at least 2.2.

18. The cleaning pad assembly of claim 17, wherein the mounting card defines a first length and the mounting card includes mounting tab extensions defining a second length of the mounting card that is longer than first length.

19. The cleaning pad assembly of claim 17, wherein a width of the mounting card is at least 7 cm and a width of the cleaning pad is of at least 8 cm.

20. The cleaning pad assembly of claim 15, wherein the marker is colored ink or dye.

* * * * *